US006508191B1

(12) United States Patent
Spoljaric

(10) Patent No.: US 6,508,191 B1
(45) Date of Patent: Jan. 21, 2003

(54) AQUA TURBO GENERATOR

(76) Inventor: Raymond E. Spoljaric, 23 Hayden Way, Newark, DE (US) 19711-6125

( * ) Notice: Subject to any disclaimer, the term of this patent is extended or adjusted under 35 U.S.C. 154(b) by 0 days.

(21) Appl. No.: 09/928,875

(22) Filed: Aug. 13, 2001

(51) Int. Cl.[7] ..... B63G 8/42
(52) U.S. Cl. ..... 114/244; 290/54
(58) Field of Search ..... 440/6; 114/242, 114/244; 290/54

(56) References Cited

U.S. PATENT DOCUMENTS 1,898,973 A * 2/1933 Lansing
3,999,499 A * 12/1976 Kitabayashi ..... 144/244
4,102,291 A * 7/1978 Sebald ..... 144/244

* cited by examiner

*Primary Examiner*—Ed Swinehart
(74) *Attorney, Agent, or Firm*—Michael I. Kroll

(57) ABSTRACT

The present invention 10 discloses an underwater generator for use with a surface vessel 12 having a cylindrical housing 30 with two major parts: a turbine 32 and a generator 36. The turbine 32 is located in the front portion of the device and is connected to the generator 36 in the rear of the device through a set of gears 34. A conical shaped filter 24 pointed forward is located in the front of the turbine 32 to prevent clogging of the device. The size of the filter rib 25 openings is smaller than the spacing between the turbine blades so that any particulate matter that passes through the filter can freely pass through the turbine and out the housing. At the junction between the conical filter 24 and the main body of the housing 30, the water is deflected into the housing by a special deflector 28 thus forcing the water to pass through the turbine 32. A water flow passage 40 is provided for a water outlet and a leak proof enclosure 38 surrounds the turbine 32, gears 34 and generator 36. The housing 30 is connected to the vessel 12 by way of mounting frame 26.

15 Claims, 9 Drawing Sheets

AQUA TURBO GENERATOR

BACKGROUND OF THE INVENTION

1. Field of the Invention

The present invention relates generally to power generating apparatus and more specifically to portable aqua power generating apparatus particularly for sailboats.

The aqua turbo generator of the present invention is a cylindrical device with two major parts: a turbine and a generator. The turbine is located in the frontal portion of the device and is connected to the generator in the rear of the device through a set of gears. A conical shaped filter pointed forward is located in the front of the turbine to prevent clogging of the device. The size of the filter opening is smaller than the spacing between the turbine blades so that any particular matter that passes through the filter can freely pass through the turbine and out the aqua turbo. At the junction between the conical filter and the main body of the unit, the water is deflected into the filter by a special deflector thus forcing the water to pass through the turbine. The turbine is located immediately behind the conical filter. The size of the turbine and the generator depend on the electrical requirements and use. The turbine is connected to the generator through a set of gears and a brake.

The gears and the brake are controlled from the boat deck. The generator, gears and the brake are housed in a leak proof enclosure to prevent the entrance of water.

The electricity produced by the generator is transmitted through the electric lines, enclosed in seawater resistant plastic, to the boat deck. Employing the appropriate voltage regulator and transformers, the electricity is distributed to electronic instruments, appliances, and other devices according to the need.

In addition, it is also used to recharge the batteries. Ball joints are used to facilitate the rotation of the turbine and the generator. The passageway of the water through the system is designed to allow for easy and smooth water flow through the system. The device of the present invention can be permanently attached to a boat or portable installation is recommended.

The portable unit can be easily pulled out of the water for cleaning and occasional maintenance. Portable installation is preferred to a permanent one because it is important that the device be continuously submerged, making service of the device difficult on a stationary installation. The portable unit can be removed easily for cleaning and servicing, With a portable installation, the depth of submergence can be controlled, while the permanent installation the depth is fixed and cannot be varied.

To operate the device, it is lowered in the water behind a boat sufficiently deep so that it is continuously submerged. As the boat moves, the water enters the unit in the front portion of the device through a conical filter, passes through the turbine and begins to rotate it. The turbine rotation is transmitted through a set of gears to the generator. The transmission increases multi-fold the speed of rotation of the generator thus producing ample amounts of electric power. After passing through the turbine, water flows around the generator housing and out the back of the unit. The flow of water also acts as a coolant maintaining the generator temperature at a constant level and preventing overheating.

The invention could also be used as a means of generating primary electricity to meet the needs of one family or several households located close to rivers.

2. Description of the Prior Art

There are other power generating apparatus designed to generate aqua power. Typical of these is U.S. Pat. No. 4,048,947 issued to Sicard on Sep. 20, 1977.

Another patent was issued to Coffer on Oct. 11, 1977 as U.S. Pat. No. 4,053,253. Yet another U.S. Pat. No. 4,141,425 was issued to Treat on Feb. 27, 1979 and still yet another was issued on Mar. 13, 1984 to Vary as U.S. Pat. No. 4,436,480.

Another patent was issued to Quintal on Aug. 28, 1984 as U.S. Pat. No. 4,468,606. Another patent was issued to Wiggs on Feb. 16, 1988 as U.S. Pat. No. 4,725,195. Another patent was issued to Hesh on Sep. 19, 1989 as U.S. Pat. No. 4,868,408. Another patent was issued to Bynum et al. on Jul. 1, 1997 as U.S. Pat. No. 5,644,170. Another patent was issued to Tether on Jan. 26, 1999 as U.S. Pat. No. 5,863,228. Another patent was issued to Szpur on Sep. 7, 1999 as U.S. Pat. No. 5,946,909. Another patent was issued to Bergstein on Sep. 7, 1999 as U.S. Pat. No. 6,947,678. Another patent was issued to Woodbridge et al. on Feb. 1, 2000 as U.S. Pat. No. 6,020,653.

Furthermore, an underwater generator is disclosed on the Internet site www.jademountain.com.

U.S. Pat. No. 4,048,947

Inventor: Charles Sicard

Issued: Sep. 20, 1977

A rotary device driven by a moving fluid, such as water or air, for generating a rotary movement comprises a cylindrical or frusto-conical rotor having a vertical axis, the rotor having a plurality of identical blades distributed around the periphery of the rotor, each blade having a symmetrical aerodynamic profile and being mounted so as to freely rotate about a substantially vertical axis parallel to its leading edge. The device may be used to power a screw driven boat, a wheeled vehicle or other machinery.

U.S. Pat. No. 4,053,253

Inventor: Carl Coffer

Issued: Oct. 11, 1977

A power generating apparatus, the construction and size of which may vary from a relatively small domestic version for individual homes to a larger commercial version for power stations, comprises a device to be anchored in and driven by a substantially horizontally flowing water stream and includes a body having an endless chain horizontally mounted on sprocket wheels fixed on spaced, vertical, rotatable shafts, the chain being continuously driven by water flow driving a plurality of paddles attached thereto and arranged to be pivotable between a vertical position to be propelled downstream by water flow through a chute and a substantially horizontal position for low-drag movement upstream back to the chute inlet, track and roller support means for the paddle assemblies and a drag bar for raising and lowering the paddles from vertical to horizontal and back then to vertical position.

U.S. Pat. No. 4,141,425

Inventor: Russell Treat

Issued: Feb. 27, 1979

Apparatus for generating electrical energy useful for powering of the electrical apparatuses associated with the operations of a vehicle, boat, residence, or other structure, including a bank of batteries associated with one of said structures and provided for furnishing the electrical energy necessary for its operations, an electrical energy producing solar panel operatively disposed with the structure for creating electrical energy for recharging of its bank of batteries, and, an impeller driven alternator, the impeller being rotated through the efforts of air passing thereby, providing also for selectively recharging of the bank of batteries of one of the identified structures. In the preferred instance, the structure comprises an electric powered vehicle, incorporating front and rear wheels, with a variable speed direct current electrical motor associated with the said wheels, gearing interconnected between the motor and the wheels, with the solar panel or alternator charged batteries conducting the electrical energy to the motor to attain its revolving and the consequent rotation of the vehicle wheels for inducing movement.

U.S. Pat. No. 4,436,480

Inventor: Philip Vary

Issued: Mar. 13, 1984

A hydro-turbine device includes a frame mounted in a channel through which water flows, the frame mounting a horizontal shaft carrying a turbine wheel having spaced end plates between which extend a plurality of arcuate vanes. A cover is mounted over the rear of the turbine wheel, and carries an extension on the front thereof that has an arcuate scoop mounted on its under side. The arcuate scoop is arranged to capture water flowing toward the turbine wheel and direct it centrally against the concave rear faces of the vanes, so as to effect maximum energy removal from the water. The cover is positioned and arranged to enhance aspirator action for efficiently removing spent water from the turbine wheel.

U.S. Pat. No. 4,468,606

Inventor: Yvan Quintal

Issued: Aug. 28, 1984

A system for charging the battery and operating the electrical accessories of a sailboat is disclosed. The system comprises an alternator having a stator winding adapted for connection to the battery through suitable current rectifiers and a rotor field winding coupled to the auxiliary propeller shaft of the boat. Circuit means for controlling the energization of the field winding of the alternator from the output voltage of the stator winding, so as to permit the alternator to provide adequate current to charge the battery and operate the electrical accessories of the sail-boat, and a voltage regulator adapted for connection to the field winding of the alternator for controlling the output voltage of the stator winding when such output voltage reaches a predetermined value.

U.S. Pat. No. 4,725,195

Inventor: B. Ryland Wiggs

Issued: Feb. 16, 1988

A water power apparatus, composed of independent, uniquely combined, and improved design features, which provides for: (1) side pontoons, the respective bows of which angle water away from the water flowing directly into the paddle wheels; (2) the addition of wheels to the cone shaped legs so as to enable vessel positioning in shallow water areas; (3) vertically dividing each respective side paddle wheel set in half, via a solid disk division extending vertically, at a right angle to, and from, the central axle to the outside extreme end of the paddle blades, off-setting the 90 degree spaced paddle blades in each such divided set by 45 degrees, and enclosing the extreme ends of each such set of divided paddle wheels via a similar solid, vertical disk enclosure extending vertically, at a right angle to, and from, the central axle to the outside extreme end of the paddle blades; (4) a gearing system utilizing the outside edge perimeter of a side paddle wheel disk enclosure, adjacent to the center boat, via vertically extended bars and/or pegs engaging roller bearings or sprockets attached to a common axle, with a sprocket or pulley in the center, extending across the forward section of the central boat from one paddle wheel to the other; (5) an angled, retractable, solid forward water deflection screen to slow and/or stop the paddle wheels via slowing and/or stopping the water striking the paddle wheels; (6) cupped flanges around the paddle wheel axle and gearing axle to prevent water from draining into shaft roller bearings; and (7) a cover for the paddle wheels to inhibit adverse effects from wind and/or water spray.

U.S. Pat. No. 4,868,408

Inventor: Frank Hesh

Issued: Sep. 19, 1989

The disclosed portable water-powered electric generator unit has a tubular form with opposite open inlet and outlet ends defining a longitudinal flow path for the moving stream water. The tubular form defines a converging venturi terminating at a throat between the inlet and outlet ends. an electric dynamo, having a sealed housing and external driving propeller means, is supported in the flow path downstream of the throat, with the propeller means at the throat. The inlet end is between 2–5 times larger in area than the venturi throat, to speed up the water passing through the propeller means. The tubular form and housing together define a diverging venturi downstream from the throat, decelerating the water with minimal losses before exiting from the open outlet end. The open outlet end is 1.1–1.5 times larger in area than the open inlet end, whereby the slightly faster surrounding stream water blending with the exiting water at the open outlet end may tend to accelerate the exiting water slightly for added efficiencies. A buoyancy chamber, with remotely operated valve and gas pressure means, is on the portable electric generator unit to regulate its overall buoyancy, for adjusting its operative depth of use in the stream.

U.S. Pat. No. 5,644,170

Inventor: David Bynum

Issued: Jul. 1, 1997

The Atmospheric/Aqua Turbine is an apparatus for producing energy by allowing air or water to be metered by controls through an adjustable air or water scoop into twin turbines to produce electricity when the atmospheric/Aqua Turbine is installed on vehicle or a boat and the vehicle is traveling at 30 mph or more or in the case of the boat the boat is traveling at 8 to 10 mph or more.

U.S. Pat. No. 5,863,228

Inventor: David Tether

Issued: Jan. 26, 1999

An auxiliary propulsion system for a boat or other marine vessel according to the invention incorporates an electric motor/transmission device for generating locomotive force to propel the boat or vessel, an electrical power supply for providing electrical energy to drive the electric motor/transmission device, at least one electrical energy generating device for generating electrical energy through conversion from one of at least sunlight, wind motion and water motion, a charging circuit having a device for controlling charging of the power supply with electrical energy from the energy generating device, and a device for controlling speed and direction operation of the electric motor/transmission device. In operation, electrical energy is inputted into the electric motor/transmission device from the electrical power supply and locomotive force is thereby generated by the electric motor/transmission device when the primary propulsion system of the boat or other marine vessel is inactive. Electrical energy to be stored in the electrical power supply is generated by converting at least one of sunlight, wind motion and water motion into electrical energy.

U.S. Pat. No. 5,946,909

Inventor: Roman Szpur

Issued: Sep. 7, 1999

A series of floating turbine rotors each have a tubular hub with outwardly projecting blades, and the rotors are connected in general axial alignment by a flexible driven shaft. The shaft includes tubular floating connector shafts and flexible couplings, and each rotor is connected to drive the shaft through a one-way ratchet clutch. One or more lines of the connected floating rotors are anchored within moving water of a river or in the waves flowing into a seashore, and the rotors drive each flexible shaft which, in turn, drives an electric generator through a fly-wheel and a power converter or drives an air compressor for producing compressed air which is stored in underground tanks and later used to drive an electric generator through an air turbine.

U.S. Pat. No. 5,947,678

Inventor: Frank Bergstein

Issued: Sep. 7, 1999

An improved liquid rotor device is provided having a cylindrically shaped hub, which is supported by a horizontal shaft, and having several curved blades which are attached to the outer portions of the rotating hub. The horizontal shaft preferably rotates with the hub so that it can mechanically drive a device such as an electrical generator. The multiple blades mounted to the exterior surface of the hub are curved such that the longitudinal axis of each blade is parallel to the axis of rotation (i.e., the horizontal shaft). Each blade is arcuate in shape and preferably comprises a portion of the cylindrical wall of a hollow cylinder. In one embodiment of the, the rotating hub and blades sub-assembly is surrounded by a hollow cylindrical housing that is entirely submerged in a liquid, such as water. The surrounding hollow cylindrical housing has an inlet to receive the liquid into the area of the rotating blades and an outlet through which the liquid is discharged. The inlet preferably is in communication with the discharge of a constricting chamber that has a large opening area and a small discharge area, such as a portion of a venturi. By use of this chamber, the velocity of the liquid is increased as it approaches the inlet.

U.S. Pat. No. 6,020,653

Inventor: David Woodridge

Issued: Feb. 1, 2000

A submerged reciprocating electric generator is placed below the ocean surface and creates electric power from the surface ocean swells. The generator coil reciprocates linearly in response to an external force acting on a float by passing ocean swells. A cable connects the float on the ocean surface with the reciprocating coil of the submerged generator. A magnetic field is focussed through the coil as it reciprocates, creating an electromotive force in the coil. The magnetic field is created in such a manner as to provide uniform field of a single magnetic orientation throughout the entire length of motion of the reciprocating coil. The generator includes a base formed on the ocean floor supporting magnetic core having a generator coil movably mounted therein and connected to a float with a cable passing through cable alignment bearings. Electromagnetic windings are mounted at the closed end of the generator magnetic flux core.

SUMMARY OF THE PRESENT INVENTION

The present invention discloses an underwater generator for use with a surface vessel having a cylindrical housing with two major parts: a turbine and a generator. The turbine is located in the front portion of the device and is connected to the generator in the rear of the device through a set of gears. A conical shaped filter pointed forward is located in the front of the turbine to prevent clogging of the device. The size of the filter rib openings is smaller than the spacing between the turbine blades so that any particulate matter that passes through the filter can freely pass through the turbine and out the housing. At the junction between the conical filter and the main body of the housing, the water is deflected into the turbine by a special deflector thus forcing the water to pass through the turbine. A water flow passage is provided for a water outlet and a leak proof enclosure surrounds the gears and generator. The housing is connected to the vessel by way of mounting frame.

A primary object of the present invention is to provide a portable aqua turbo generator designed to provide electrical power particularly for sailboats.

Another object of the present invention is to provide a device that produces electricity continuously while the sailboat is in motion, transmitting power for operation of instruments, appliances and to recharge batteries aboard the vessel.

Yet another object of the present invention is to provide an aqua turbo generator consisting of a cylindrical housing containing a turbine, located in the front portion of the device and is connected to a generator in the rear of the device, through a set of transmission type gears. Also, a conical shaped filter pointed forward is located in the front of the turbine to prevent clogging.

Still yet another object of the present invention is to provide a conical shaped filter pointed forward and is located in the front of the turbine to prevent clogging of the unit. The filter opening is smaller then the spacing between the turbine blades so that any particular matter that passes through the filter can freely pass through the turbine and out the aqua turbo.

Yet another object of the present invention is to provide a leak proof enclosure, housing a generator, gears and brake and is controlled from the boat deck.

Yet another object of the present invention is to provide a unit that electricity is produced by the generator and transmitted through power lines enclosed in seawater resistant plastics, to the boats deck and distributed to the electrical instruments, appliances and to recharge batteries.

Additional objects of the present invention will appear as the description proceeds.

The present invention overcomes the shortcomings of the prior art by providing a seawater resistant, portable, aqua turbo generator that is lowered into water behind a sailboat, sufficiently deep so that it is continuously completely submerged, so as the boat moves water enters the turbine through a conical shaped filter located at the front of the device, and rotates the turbine. This rotation is transmitted through a set of transmission type gears to a generator. After passing through the turbine, the water flows around the generator housing and out the rear portion of the aqua turbo and acts as a coolant preventing overheating. The generated electrical power is transmitted to the deck of the vessel via seawater resistant power lines and distributed to electronic instruments, appliances and battery recharger.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim.

BRIEF DESCRIPTION OF THE DRAWINGS

With regard to reference numerals used, the following numbering is used throughout the drawings.

LIST OF REFERENCE NUMERALS

Figure 1:
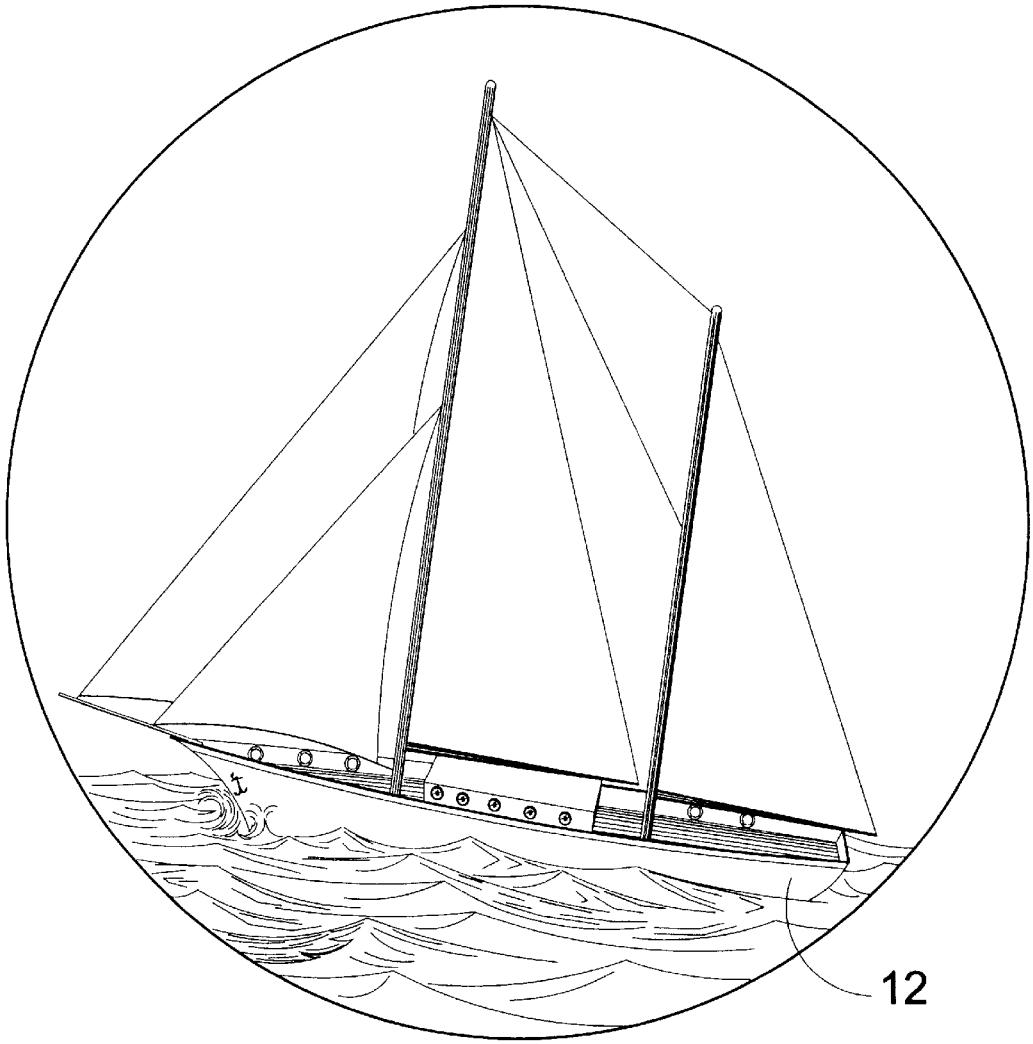
FIG. 1 is an illustrative view of the present invention in use.

With regard to reference numerals used, the following numbering is used throughout the drawings.

10 present invention
12 vessel
14 control bridge
16 engine compartment
18 battery recharge
20 electronics bay
22 voltage regulator and transformers
24 filter
25 ribs
26 mounting frame
27 circular clamp
28 flow deflector
30 housing
32 turbine
34 transmission and brake
36 generator
38 leakproof enclosure
40 water flow passageway
42 water flow arrows
44 direction arrow
46 direction arrow

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to appended claims.

Turning to FIG. 1, shown therein is an illustrative view of the present invention in use. The present invention is a device designed to provide electric power particularly for sailboats 12 or other vessels or the like. It produces electricity continuously while the sailboat 12 is in motion. The generated electric power can be utilized to recharge the batteries and operate electronic instruments and appliances on board.

Figure 2:
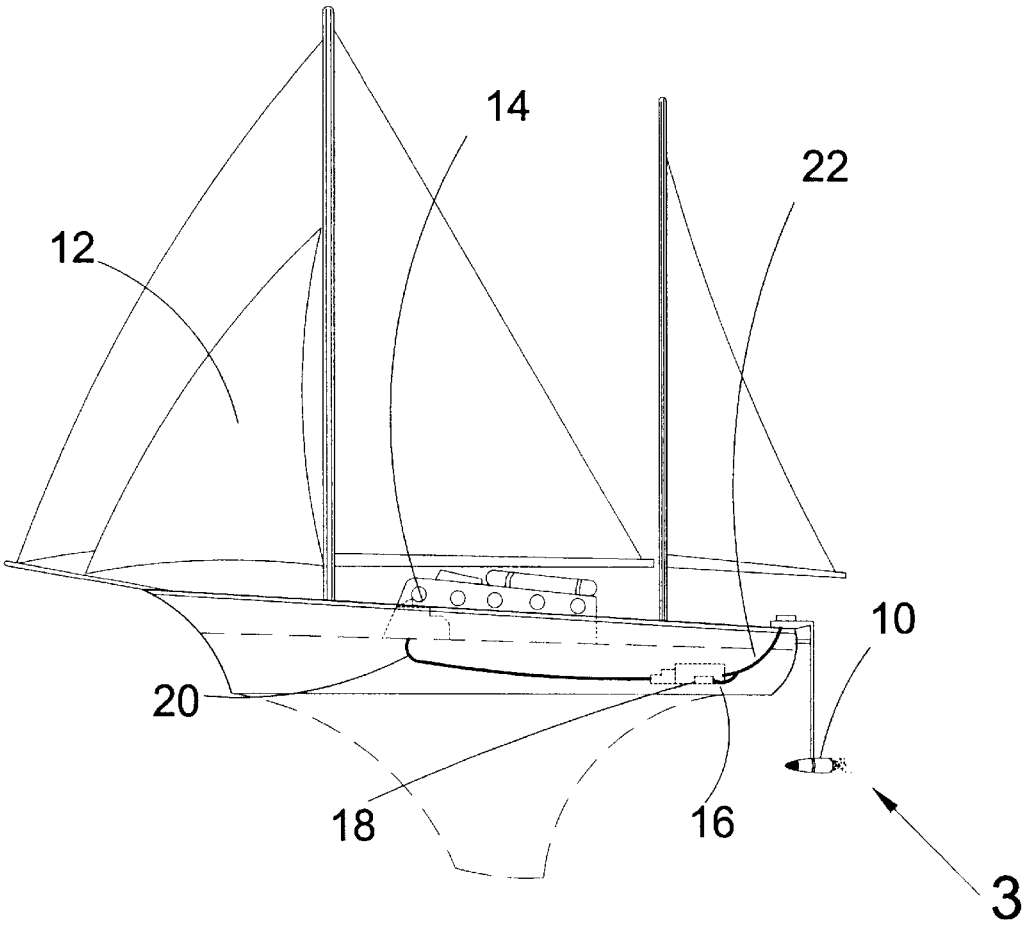
FIG. 2 is a pictorial view of the present invention in use.

Turning to FIG. 2, shown therein is a pictorial view of the present invention 10 in use. The portable turbo generator of the present invention 10 can be permanently installed on the side or the bottom of a boat 12 or can be portable and lowered below the water level only when the boat is in motion and when there is a need for electrical power. The device can be pulled on the deck for occasional cleaning and maintenance. Shown are the control bridge 14, the engine compartment 16, along with connectors to battery recharger 18, to the electronics bay 20 and the voltage regulator and transformer 22.

Figure 3:
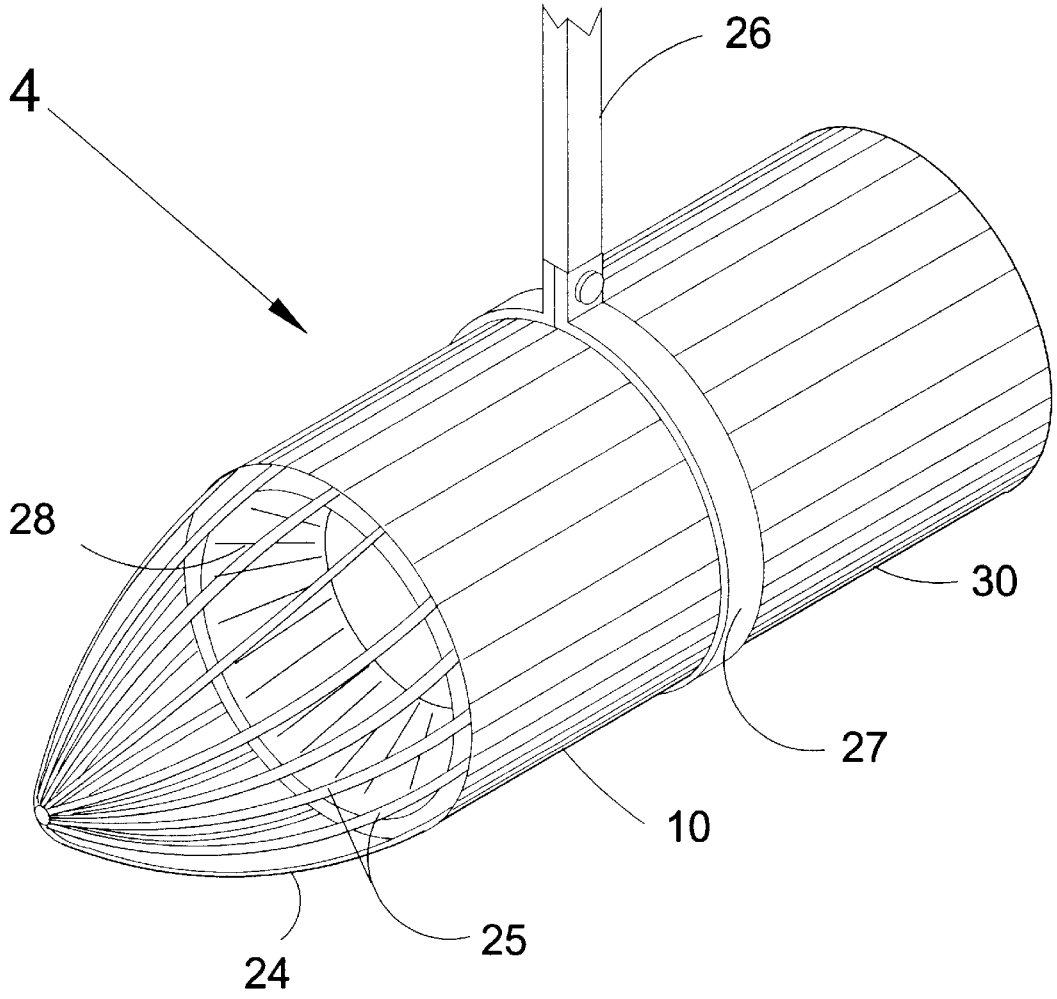
FIG. 3 is a perspective view of the present invention.

Turning to FIG. 3, shown therein is a perspective view of the present invention 10. The aqua turbo generator of the present invention 10 is cylindrical in shape and consists of two major parts, a turbine and a generator. A conical shaped filter 24 having a plurality of ribs 25 thereon pointed forward located in front of the turbine to prevent the clogging of the unit. The size of the filter openings is smaller then the space between the turbine blades so that any particulate matter that passes through the filter can freely pass through the turbine and out the aqua turbo unit. Also shown are the mounting frame 26 with circular clamp 27 surrounding housing 30, flow deflector 28 and cylindrical housing 30.

Figure 4:
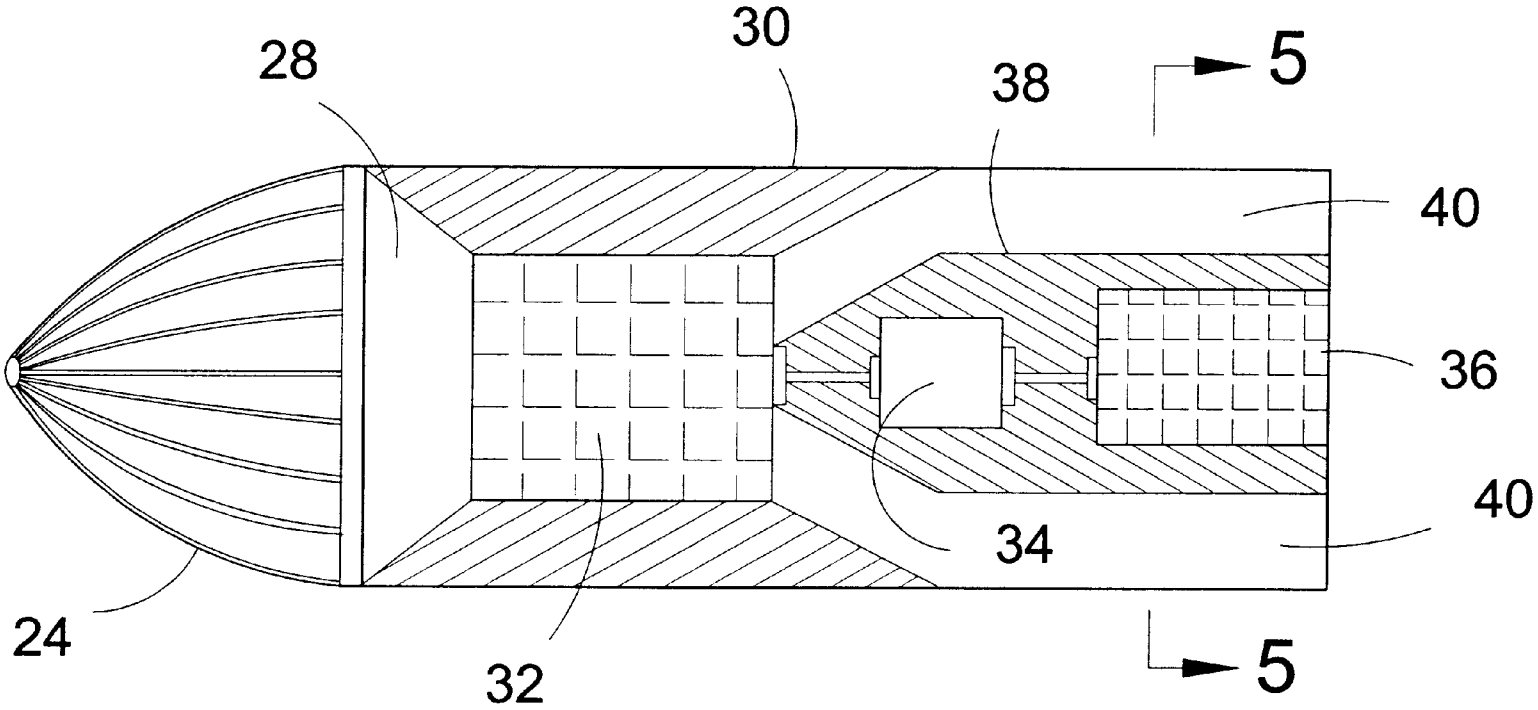
FIG. 4 is a side sectional view of the present invention.

Turning to FIG. 4, shown therein is a side sectional view of the present invention 10. At the junction between the conical filter 24 and the main body housing 30 of the device, the water is deflected inwardly, by the flow deflector 28, into the interior of the filter by a special deflector 28 thus forcing the water to pass through the turbine 32. The turbine is located immediately behind the conical filter 24. The size of the turbine and the generator depend on the electrical requirements and the use. The turbine 32 is connected to the generator through a set of gears (transmission) 34 and a brake 34. The gears 34 and the brake 34 are controlled from the boat deck. The generator 36, gears 34, and brake 34 are housed in a leak proof enclosure 38 to prevent entrance of water. Also shown are the housing 30 and a water flow passageway 40.

Figure 5:
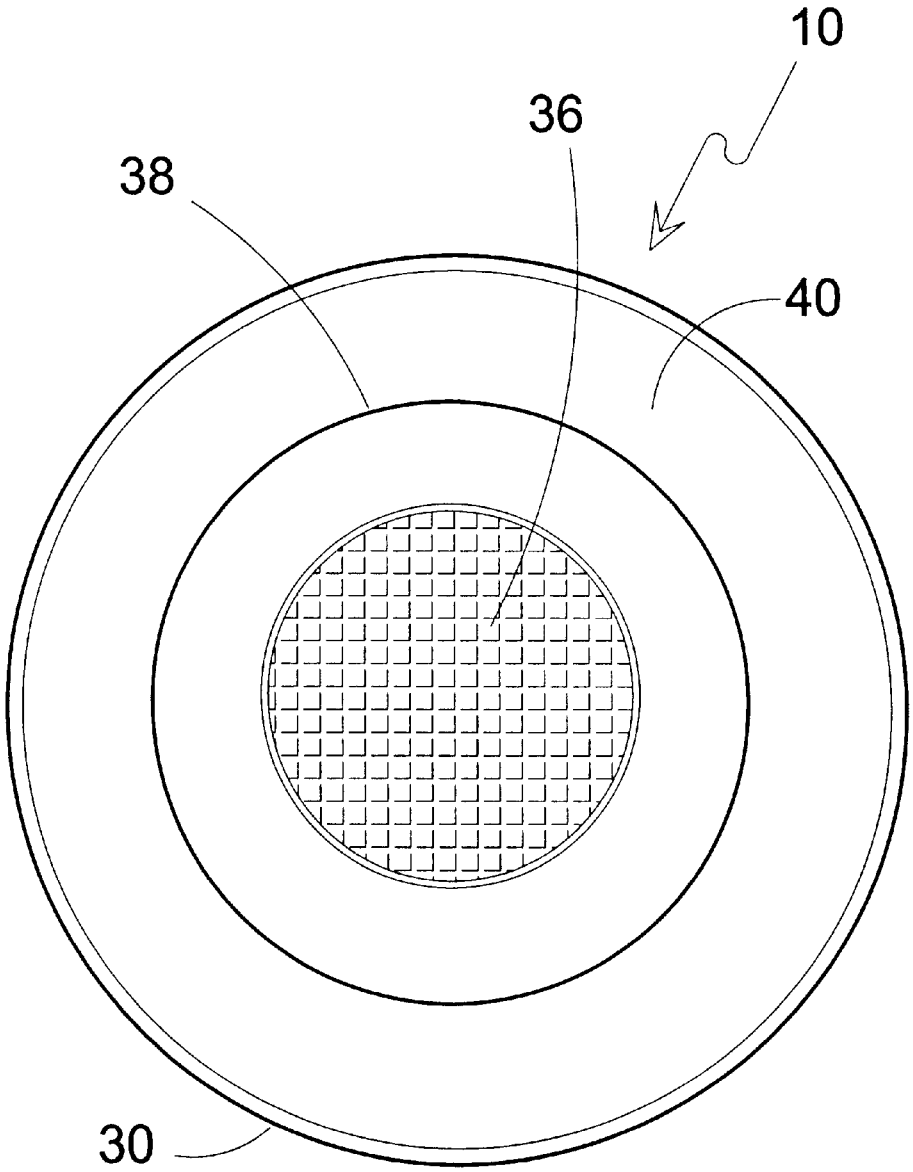
FIG. 5 is a sectional view of the present invention.

Turning to FIG. 5, shown therein is a sectional view of the present invention 10. The passageway 40 for the water through the system is designed to allow for an easy and smooth water flow that also acts as a coolant maintaining the generator 36 temperature at a constant level and preventing overheating. Also shown are the housing 30 and leakproof enclosure 38.

Figure 6:
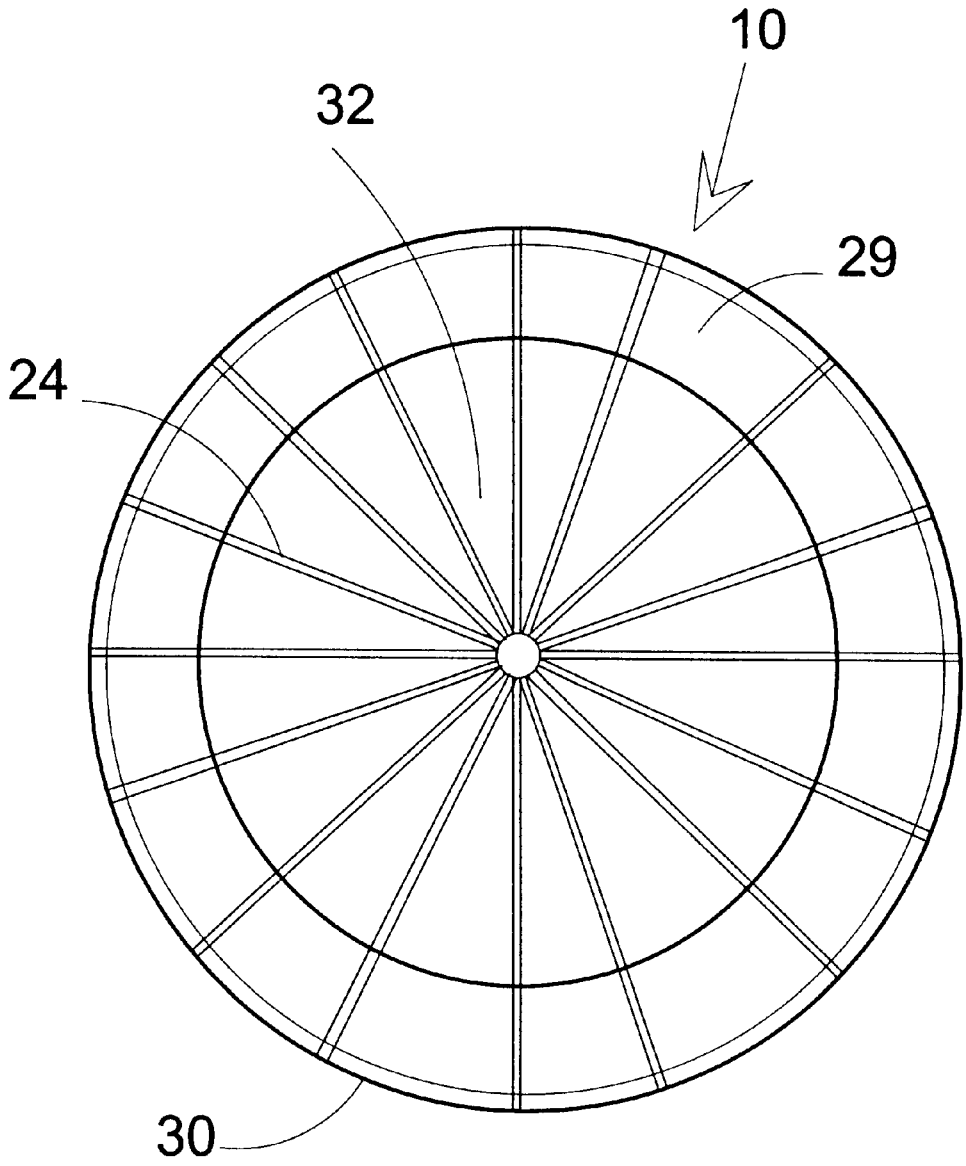
FIG. 6 is a front view of the present invention.

Turning to FIG. 6, shown therein is a frontal view of the present invention 10. The type and number of gears depend on the required rotation speed of the generator to produce the needed electric power. The electricity produced by the generator is transmitted through electric lines, enclosed in seawater resistant plastics, to the boat deck. Employing the appropriate voltage regulator and transformers, the electricity is distributed to electronic instruments, appliances and other devices according to the needs thereof. In addition, it is also used to recharge the boat batteries. Shown are the housing 30, filter 24, water flow deflector 28, and turbine 32.

Figure 7:
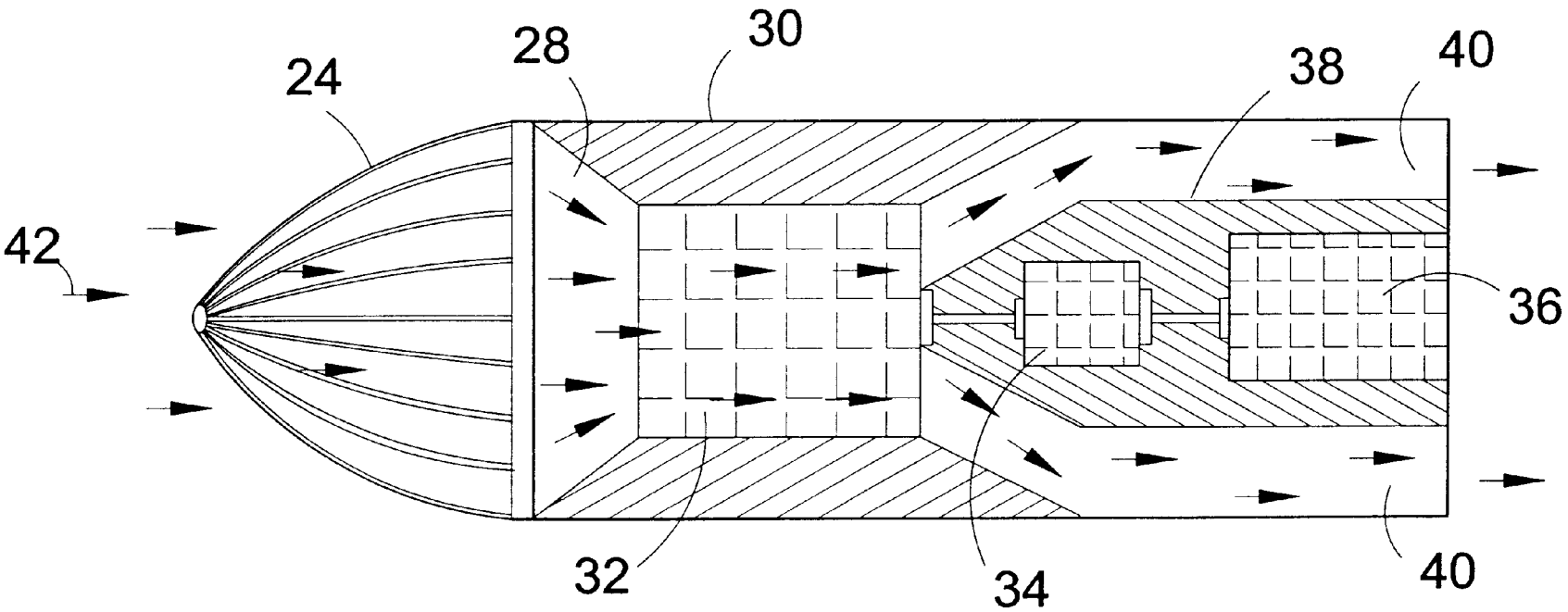
FIG. 7 is a side sectional view of the water flow through the interior housing of the present invention.

Turning to FIG. 7, shown therein is a side sectional view of the water flow 40 (shown by arrows 42) through the interior housing of the present invention 10. The passageway 40 of the water through the system is designed to allow for an easy and smooth water flow that also acts as a coolant maintaining the generator 36 temperature at a constant level and preventing overheating. Ball joints are used to facilitate the rotation of the turbine and generator. Other elements previously disclosed are also shown.

Figure 8:
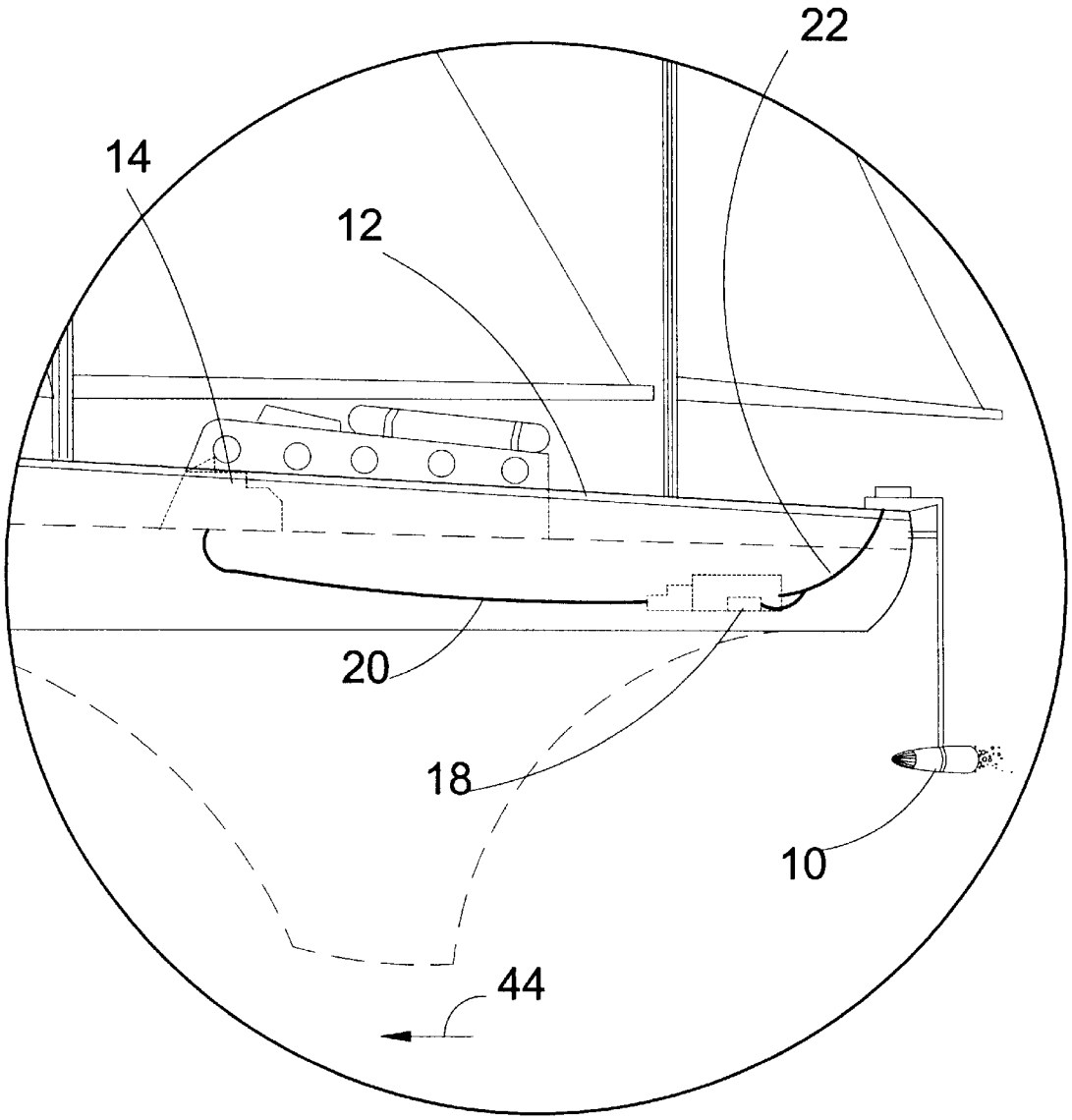
FIG. 8 is a pictorial view of the present invention in use.

Turning to FIG. 8, shown therein is a pictorial view of the present invention 10. The operation of the unit of the present invention is simple. Note, arrow 44 indicates direction of sailing. The device is lowered into the water behind the boat 12 sufficiently deep so that it is continuously submerged. As the boat moves, the water enters the unit from the front, through the conical filter, passes through the turbine and begins to rotate it. The turbine rotation is transmitted through the set of gears to the generator. The transmission increases multi-fold the speed of rotation of the generator thus producing ample amounts of electric power. After passing through the turbine, water flows around the generator housing and out the back of the unit. Other elements previously shown are also disclosed.

Figure 9:
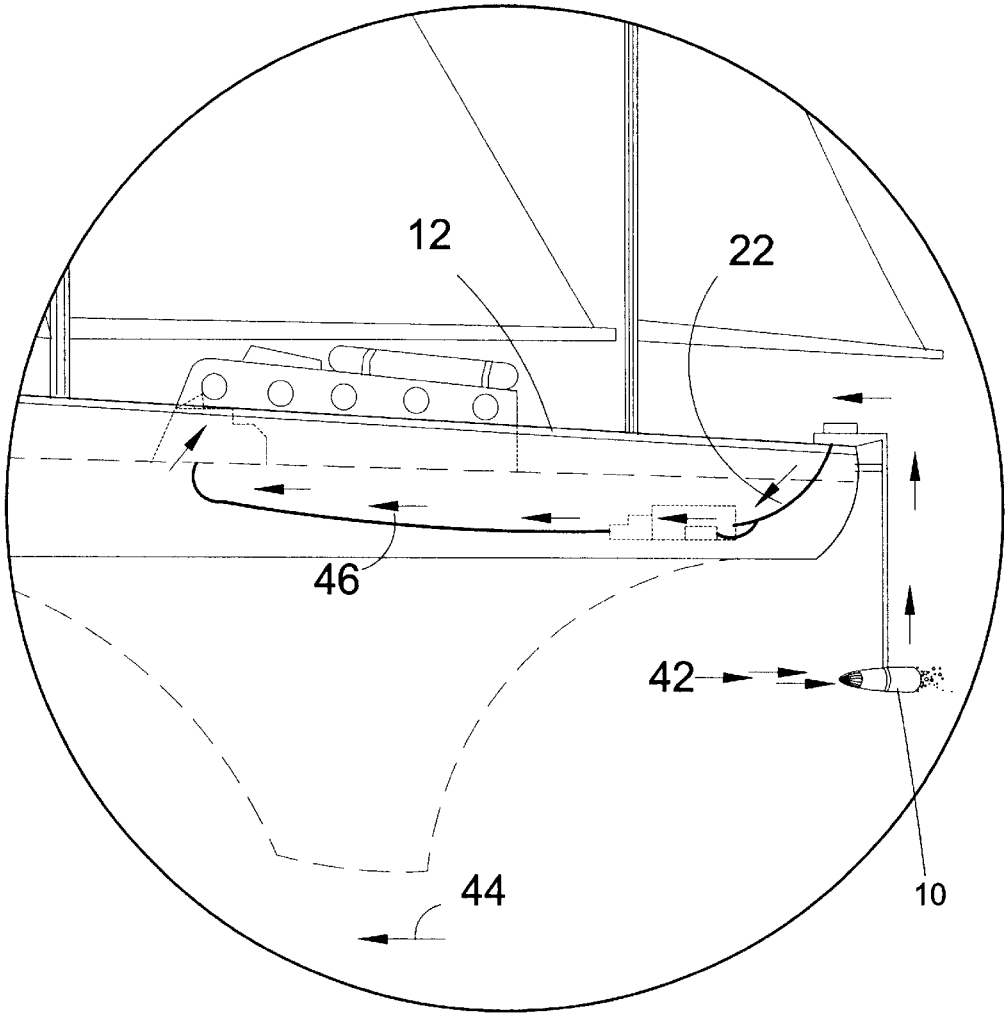
FIG. 9 is a pictorial view of the present invention in use.

Turning to FIG. 9, shown therein is a pictorial view of the present invention showing the flow of generated power by direction arrows 46. Other elements previously shown are also disclosed.

What is claimed to be new and desired to be protected by letters patent is set forth in the appended claims.

I claim:

1. An apparatus for an underwater electric generator for use with a surface vessel, comprising;

a) a housing, said housing being disposed underwater, said housing having a first front end and a second rear end, said housing being open on said first and second ends so that water can flow from said front end to said rear end of said housing;

b) a filter disposed on said front of said housing for removing large objects from the water;

c) a turbine disposed internal said housing for being rotated by the water, said turbine having a front end and a rear end;

d) an electric generator disposed internal said housing for being turned by said turbine, said generator having a front end and a rear end;

e) a transmission and a brake disposed internal said housing for connection of said rear end of said turbine to said front end of said generator for electricity to be generated by said generator;

f) a water outlet for water to pass out said rear of said housing; and, g) means for connecting said housing to the vessel whereby said housing is disposed underwater for use with the vessel.

2. The apparatus of claim 1, wherein said housing is cylindrical.

3. The apparatus of claim 2, wherein said housing is generally horizontally disposed.

4. The apparatus of claim 3, wherein said filter is conically shaped, said filter comprising a plurality of ribs wherein said ribs are conically shaped.

5. The apparatus of claim 4, wherein said turbine blades are sized to have larger spaces between than the spaces between said ribs of said filter for the filter to effectively remove large objects from the water.

6. The apparatus of claim 5, wherein said turbine further comprises ball joints to facilitate the rotation of said turbine.

7. The apparatus of claim 6 wherein said generator further comprises ball joints to facilitate the rotation of said generator.

8. The apparatus of claim 7, further comprising means for controlling said transmission and said brake from the vessel.

9. The apparatus of claim 8, wherein said water outlet is disposed between said generator and said housing, said water outlet surrounding said generator for cooling the generator.

10. The apparatus of claim 9, wherein said means for connecting said housing to the vessel further comprises a rod having a first end and a second end, wherein said first end is attached to said housing and said second end is attached to the vessel.

11. The apparatus of claim 10, further comprising a circular clamp surrounding said housing for attaching said first end of said rod to said housing.

12. The apparatus of claim 11, wherein said second end of said rod is fixedly attached to the vessel for permanent mounting.

13. The apparatus of claim 12, wherein said second end of said rod is removably attached to the vessel for portable mounting.

14. The apparatus of claim 13, further comprising a means for a flow deflector disposed on said front end of said turbine whereby water is directed inwardly into said turbine.

15. The apparatus of claim 14, wherein said means for a flow deflector further comprises a circular flow deflector, said flow deflector having a diameter approximately equal to said filter on a first front end and a diameter approximately equal to said turbine on a second rear end.

* * * * *